US009533790B2

(12) United States Patent
Williams

(10) Patent No.: US 9,533,790 B2
(45) Date of Patent: Jan. 3, 2017

(54) FOLDABLE AND STACKABLE BARN BOX

(71) Applicant: Sarah N. Williams, Morton Grove, IL (US)

(72) Inventor: Sarah N. Williams, Morton Grove, IL (US)

(73) Assignee: Southern Champion Tray, LP, Chattanooga, TN (US)

( * ) Notice: Subject to any disclaimer, the term of this patent is extended or adjusted under 35 U.S.C. 154(b) by 0 days.

(21) Appl. No.: 14/633,368

(22) Filed: Feb. 27, 2015

(65) Prior Publication Data

US 2016/0039559 A1 Feb. 11, 2016

Related U.S. Application Data

(60) Provisional application No. 62/035,833, filed on Aug. 11, 2014.

(51) Int. Cl.

| | |
|---|---|
| ***B65D 5/46*** | (2006.01) |
| ***B65D 5/00*** | (2006.01) |
| ***B65D 5/02*** | (2006.01) |

(52) U.S. Cl.

CPC ..... *B65D 5/001* (2013.01); *B65D 5/029* (2013.01); *B65D 5/46112* (2013.01)

(58) Field of Classification Search

None

See application file for complete search history.

(56) References Cited

U.S. PATENT DOCUMENTS

| | | | | | |
|---|---|---|---|---|---|
| 1,810,743 | A * | 6/1931 | Allen | B65D 5/46096 | 114/77 R |
| 1,953,885 | A * | 4/1934 | McAleer | B65D 5/46096 | 229/117.15 |
| 1,982,962 | A * | 12/1934 | McAleer | B65D 5/46128 | 229/117.14 |
| 2,007,810 | A * | 7/1935 | Oman | B65D 5/46112 | 229/117.15 |
| 2,844,299 | A * | 7/1958 | Kessler | B65D 5/46032 | 229/117.14 |
| 4,311,268 | A * | 1/1982 | Soliven | B65D 5/46096 | 229/117.12 |
| 4,403,728 | A * | 9/1983 | Koltz | B65D 5/46112 | 229/117.15 |
| 5,275,331 | A * | 1/1994 | Chung-Piao | B65D 5/46088 | 229/117 |

(Continued)

*Primary Examiner* — Gary Elkins

(74) *Attorney, Agent, or Firm* — Dunlap Bennett & Ludwig PLLC

(57) ABSTRACT

A foldable box with a base and a sidewall extending from the base is provided. The sidewall includes an upper edge forming an opening into the box. The box further includes a first flap foldably attached to the upper edge of the sidewall and a second flap foldably attached to the upper edge of the sidewall opposite the first flap. A pair of side flaps are each foldably attached to the upper edge of the sidewall on opposite sides of one another. Each of the side flaps include a side flap slit. Each of the first flap and the second flap include a handle hole formed through an upper portion, and at least one tab extending from an upper edge. At least one of the first flap and the second flap include a flap slit. The tabs are formed to fit and secure within the side flap slits in an extended position and the flap slit in a stackable position.

4 Claims, 4 Drawing Sheets

(56) References Cited

U.S. PATENT DOCUMENTS

| | | | | | |
|---|---|---|---|---|---|
| 5,582,343 | A * | 12/1996 | Dalvey | B65D 5/0005 | 229/101 |
| 6,059,179 | A * | 5/2000 | Giampapa | A45C 7/0095 | 206/457 |
| 6,182,465 | B1 * | 2/2001 | Ricci | B65D 5/244 | 62/371 |
| 7,325,718 | B2 * | 2/2008 | Cook | B65D 5/008 | 220/826 |
| 2001/0004088 | A1 * | 6/2001 | Lau | B65D 5/2033 | 229/117.15 |

* cited by examiner

FOLDABLE AND STACKABLE BARN BOX

CROSS-REFERENCE TO RELATED APPLICATION

This application claims the benefit of priority of U.S. provisional application No. 62/035,833, filed Aug. 11, 2014, the contents of which are herein incorporated by reference.

BACKGROUND OF THE INVENTION

The present invention relates to foldable boxes and, more particularly, to a foldable barn box that is stackable.

A barn box is a foldable and disposable box that stores food and other goods. Traditional barn boxes fold into a triangular shape at the top and therefore cannot be stacked in their erected form. Since triangular topped barn boxes cannot be stacked, the boxes are less desirable for applications such as catering. Caterers are more likely to choose a traditional flat top box since flat top boxes stack well. However, the caterer is sacrificing the easily carried barn box which includes a built-in handle.

As can be seen, there is a need for a barn box that may be folded into a stackable position.

SUMMARY OF THE INVENTION

In one aspect of the present invention, a foldable box comprises: a base; a sidewall extending from the base and comprising an upper edge forming an opening into the box; a first flap foldably attached to the upper edge of the sidewall; a second flap foldably attached to the upper edge of the sidewall opposite the first flap; and a pair of side flaps each foldably attached to the upper edge of the sidewall and opposite of one other, wherein each of the side flaps comprises a side flap slit, wherein each of the first flap and the second flap comprise a handle hole formed through an upper portion, and at least one tab extending from an upper edge, wherein at least one of the first flap and the second flap comprises at least one flap slit, wherein the tabs are formed to fit and secure within the side flap slits in an extended position and the flap slit in a stackable position.

These and other features, aspects and advantages of the present invention will become better understood with reference to the following drawings, description and claims.

BRIEF DESCRIPTION OF THE DRAWINGS

FIG. 4 is a perspective view of the present invention shown with the side flaps folded in;

DETAILED DESCRIPTION OF THE INVENTION

Figure 1:
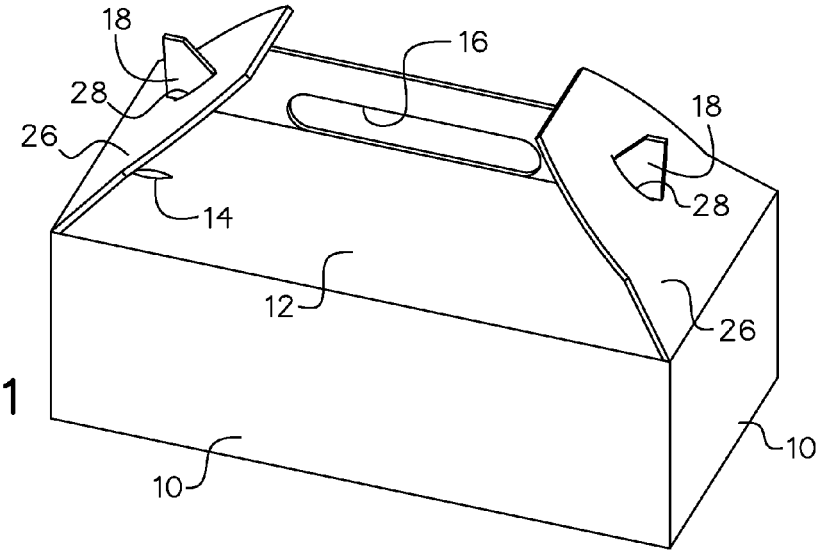
FIG. 1 is a perspective view of the present invention shown in the extended position.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring to FIGS. 1 through 7, the present invention includes a foldable box 10 with a base and a sidewall extending from the base. The sidewall includes an upper edge forming an opening into the box 10. The box 10 further includes a first flap 12 foldably attached to the upper edge of the sidewall and a second flap 20 foldably attached to the upper edge of the sidewall opposite the first flap 12. A pair of side flaps 26 are each foldably attached to the upper edge of the sidewall on opposite sides of one another. Each of the side flaps 26 include a side flap slit 28. Each of the first flap 12 and the second flap 20 include a handle hole 16 formed through an upper portion, and at least one tab 18, 24 extending from an upper portion. At least one of the first flap 12 and the second flap 20 include a flap slit 14, 30. The tabs 18, 24 are formed to fit and secure within the side flap slits 28 in an extended position and the flap slit 14, 30 in a stackable position.

As illustrated in the Figures, the base of the present invention may be flat and transverse, supporting the box 10 in an upright position. The sidewall of the present invention may have four sides, including a first side, a second side opposite the first side, a third side, and a fourth side opposite the third side. The sidewall may have a rectangular cross section.

The first flap 12 of the present invention may be foldably attached to the upper edge of the first side. In certain embodiments, the first flap 12 may extend from the upper edge and form a crease in between the first flap 12 and the first side. The first flap 12 is foldable about the crease. The first flap 12 may include a lower portion, an upper portion, a first side and a second side. The handle opening 16 may be near the upper portion, a first flap slit 14 may be near a first side in between the handle opening 16 and the lower portion, and a second flap slit 14 may be near the second side in between the handle opening 16 and the lower portion. The first flap slit 14 and the second flap slit 14 may be a horizontal slit. A first tab 18 may extend from the upper portion at the first side, and a second tab 18 may extend from the upper portion at the second side.

The second flap 20 of the present invention may be foldably attached to the upper edge of the second side of the sidewall. In certain embodiments, the second flap 20 may extend from the upper edge and form a crease in between the second flap 20 and the second side. The second flap 20 is foldable about the crease. The second flap 20 may include a lower portion, an upper portion, a first side and a second side. The handle opening 22 may be near the upper portion, a first flap slit 30 may be near a first side in between the handle opening 22 and the lower portion, and a second flap slit 30 may be near the second side in between the handle opening 16 and the lower portion. The first flap slit 30 and the second flap slit 30 may be a horizontal slit. A first tab 24 may extend from the upper portion at the first side, and a second tab 24 may extend from the upper portion at the second side.

A first side flap 26 of the present invention may be foldably attached to the upper edge of the third side of the sidewall. In certain embodiments, the first side flap 26 may extend from the upper edge and form a crease in between the first side flap 26 and the third side. The first side flap 26 is foldable about the crease. The first side flap 26 may include a lower portion and an upper portion. The side flap slit 28 may be in between the lower portion and the upper portion. The side flap slit 28 may be a vertical slit.

A second side flap 26 of the present invention may be foldably attached to the upper edge of the fourth side of the sidewall. In certain embodiments, the second side flap 26 may extend from the upper edge and form a crease in between the second side flap 26 and the fourth side. The second side flap 26 is foldable about the crease. The second side flap 26 may include a lower portion and an upper portion. The side flap slit 28 may be in between the lower portion and the upper portion. The side flap slit 28 may be a vertical slit.

Figure 2:
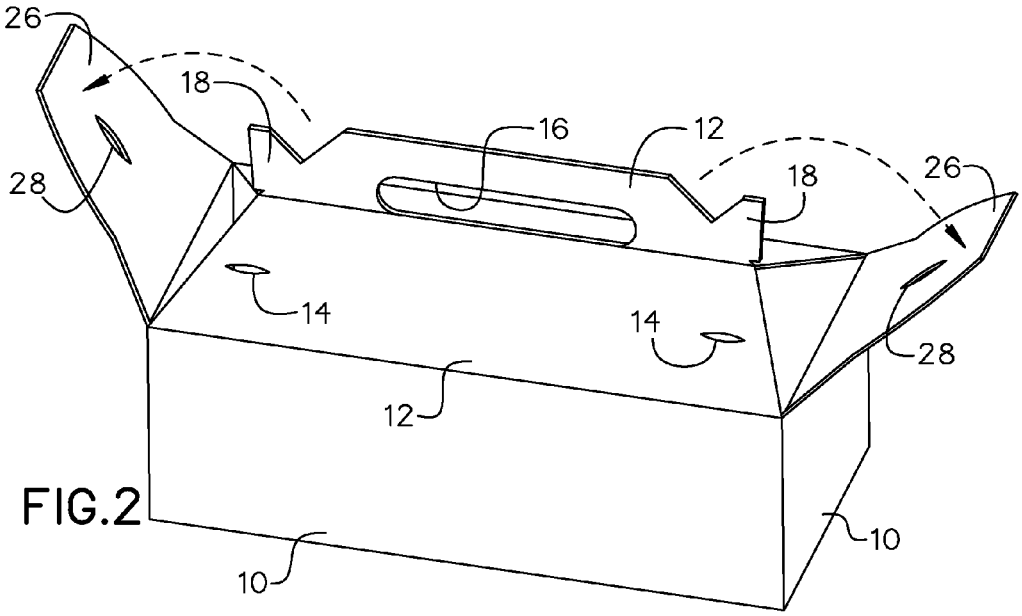
FIG. 2 is a perspective view of the present invention shown with side flaps folded out.
Figure 3:
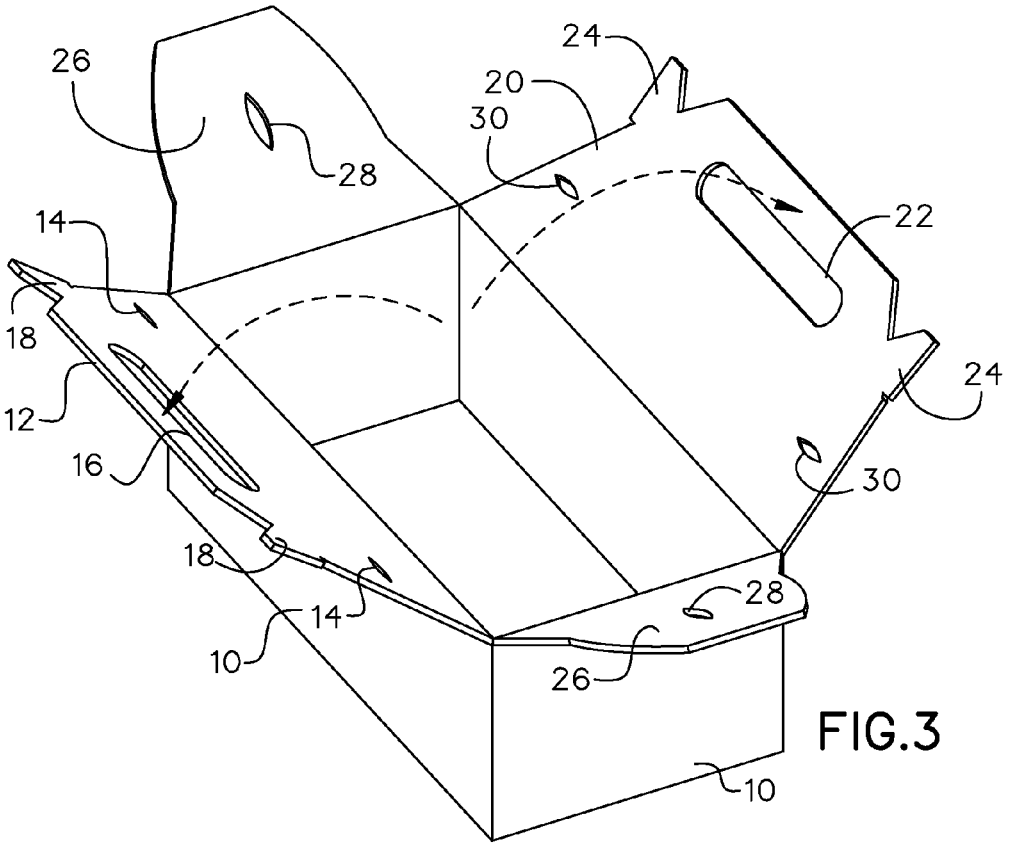
FIG. 3 is a perspective view of the present invention shown with the first and second flaps folded out.
Figure 4:
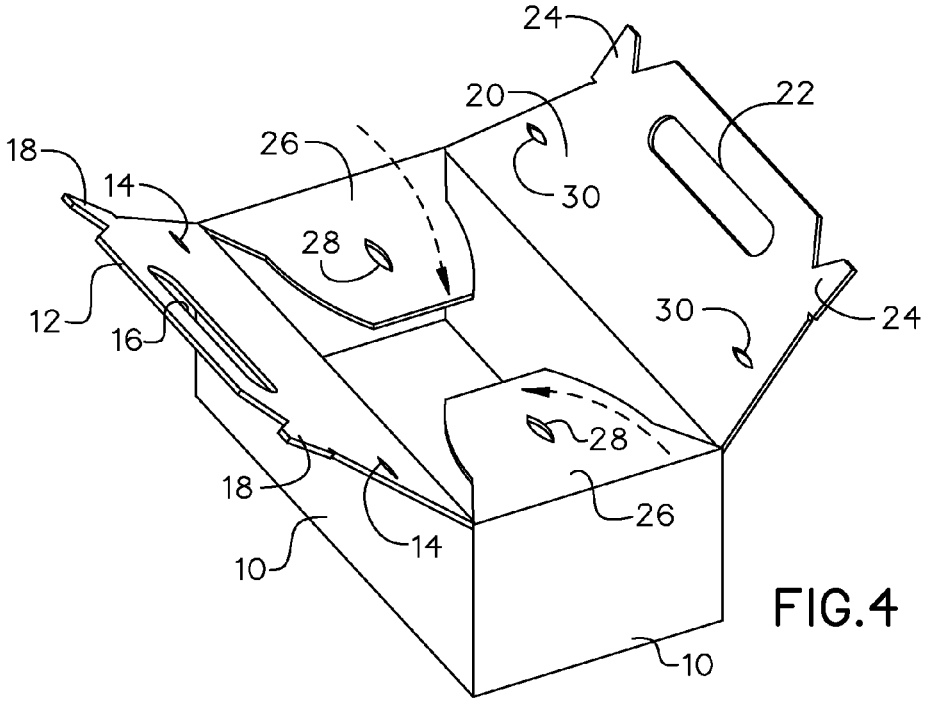
Figure 5:
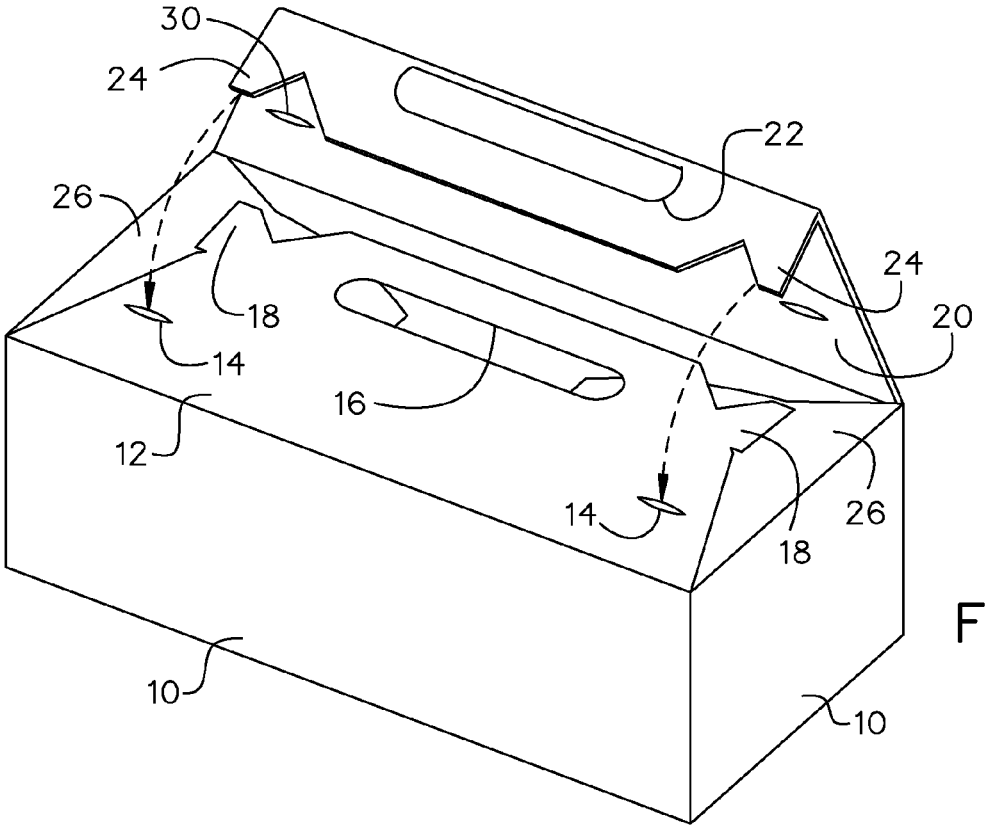
FIG. 5 is a perspective view of the present invention shown with the first flap folded down.
Figure 6:
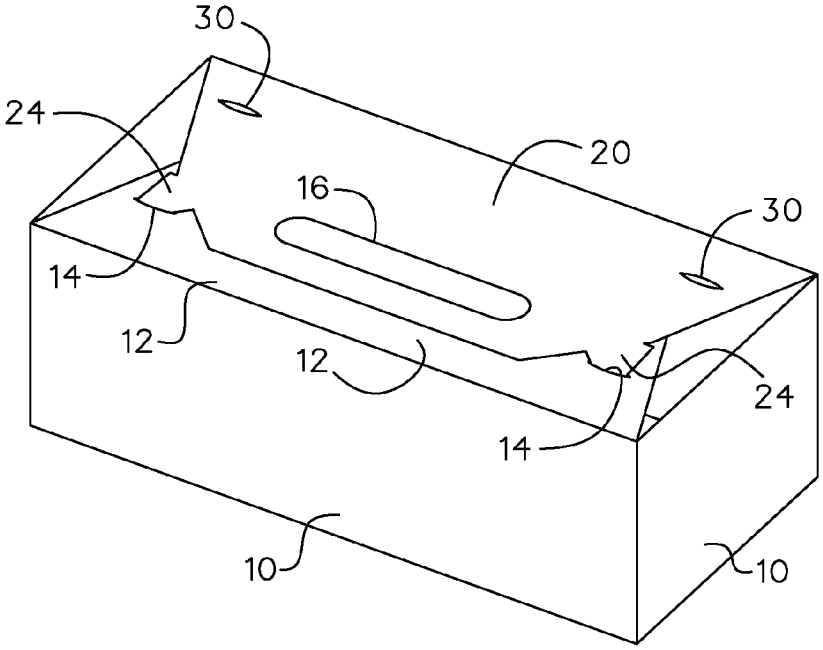
FIG. 6 is a perspective view of the present invention shown with the second flap folded down and secured within a slit.

As illustrated in FIGS. 1 through 3, the box 10 may be folded in the extended position. The first flap 12 and the second flap 20 are folded towards one another so that the handle holes 16, 22 align. The first side flap 26 is folded towards the first side of the first flap 12 and the second flap 20. The first tabs 18, 24 of the first flap 12 and the second flap 20 may be inserted into the side flap slit 28 of the first side flap 26. The second side flap 26 is folded towards the second side of the first flap 12 and the second flap 20. The second tabs 18, 24 of the first flap 12 and the second flap 20 may be inserted into the side flap slit 28 of the second side flap 26. Inserting the tabs 18, 24 into the side flap slits 28 secures the flaps 12, 20, 26 in a triangular and erected position, ready for use.

Figure 7:
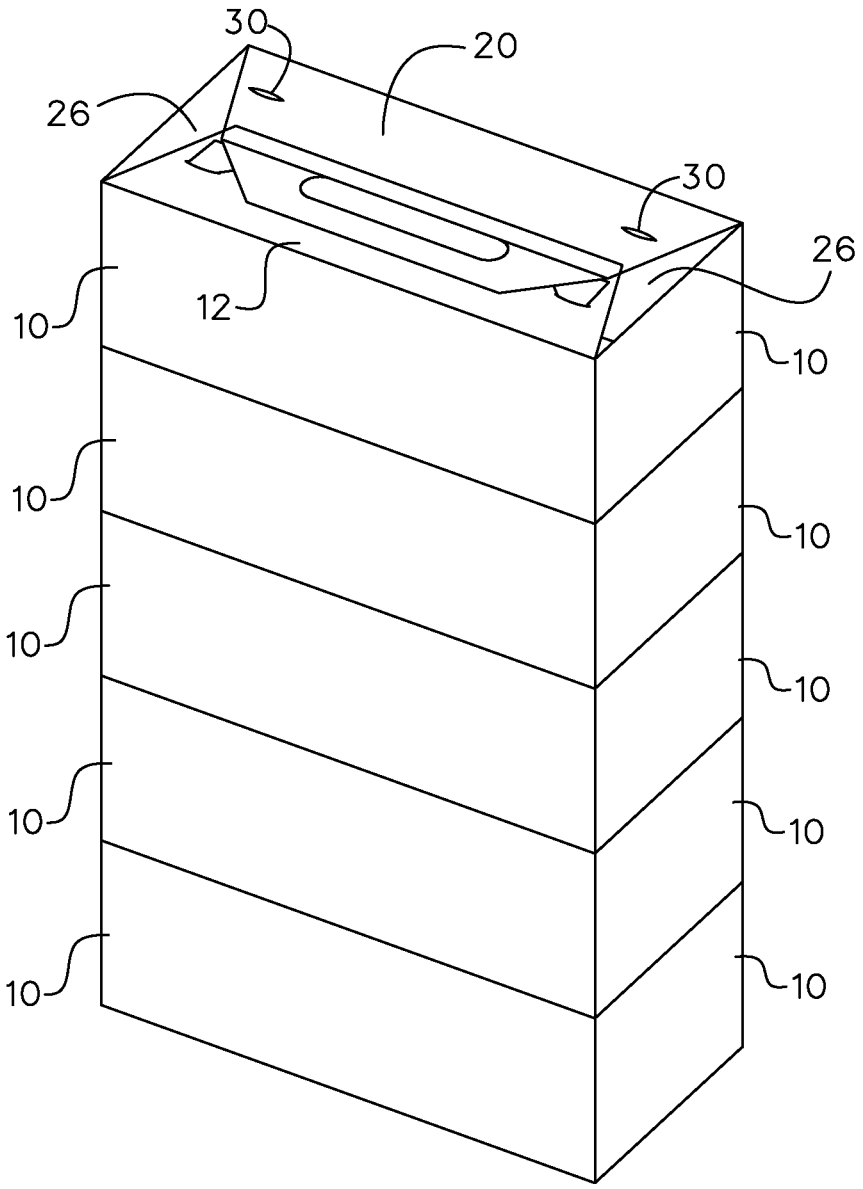
FIG. 7 is a perspective view of the present invention demonstrating a plurality of boxes in a stacked position.

As illustrated in FIGS. 4 through 7, the box 10 may be folded in the stackable position with a flat top. The pair of side flaps 26 are folded down substantially perpendicular relative to the sidewall. The first flap 12 and second flap 20 are folded over the pair of side flaps 26 and are substantially perpendicular relative to the sidewall. The tabs 24 of the second side flap 20 are inserted into the flap slits 14 of the first side flap 12. Alternatively, the tabs 18 of the first side flap 12 are inserted into the flap slits 30 of the second side flap 20. Inserting the tabs 18, 24 into the flap slits 14, 30 secures the flaps 12, 20, 26 a perpendicular and stackable position. As illustrated in FIG. 7, a plurality of boxes 10 in the stackable position may be stacked vertically relative to one another.

It should be understood, of course, that the foregoing relates to exemplary embodiments of the invention and that modifications may be made without departing from the spirit and scope of the invention as set forth in the following claims.

What is claimed is:

1. A foldable box comprising:

a base;

a sidewall extending from the base and comprising an upper edge forming an opening into the box;

a first flap foldably attached to the upper edge of the sidewall;

a second flap foldably attached to the upper edge of the sidewall opposite the first flap; and a pair of side flaps each foldably attached to the upper edge of the sidewall and opposite of one other, wherein each of the side flaps comprises a side flap slit, wherein each of the first flap and the second flap comprise a handle hole formed through an upper portion, a pair of flap slits, and a pair of tabs extending from an upper edge, wherein a first pair of the tabs of the first flap and the second flap secures within one of the side flap slits and a second pair of the tabs of the first flap and the second flap secures within the other of the side flap slits in an extended position and, wherein the pair of the tabs of the first flap secures within the pair of flap slits of the second flap in a stackable position.

2. The foldable box of claim 1, wherein the stackable position comprises the pair of side flaps folded substantially perpendicular relative to the sidewall, and the first and second flap folded over the pair of side flaps substantially perpendicular relative to the sidewall.

3. The foldable box of claim 1, wherein the extended position comprises the first flap folded towards the second flap so that the handle holes align, and wherein the pair of side flaps are folded towards the first flap and the second flap so that the tabs are within the side flap slits.

4. The foldable box of claim 1, wherein the side flap slits are vertical slits and the flap slit is a horizontal slit.

* * * * *